United States Patent [19]

Meunier

[11] 4,351,119

[45] Sep. 28, 1982

[54] APPARATUS AND METHOD FOR DRYING COMPACT, VITRIFIABLE MIXTURES

[75] Inventor: Georges Meunier, Boulogne, France

[73] Assignee: Isover Saint-Gobain, Neuilly sur Seine, France

[21] Appl. No.: 153,789

[22] Filed: May 27, 1980

[30] Foreign Application Priority Data

May 28, 1979 [FR] France ..... 79 13500

[51] Int. Cl.[3] ..... F26B 3/14

[52] U.S. Cl. ..... 34/28; 34/65; 34/169; 432/96; 432/98

[58] Field of Search ..... 432/95–101; 34/165, 168, 169, 171, 172, 174, 211, 212, 65, 67, 28, 34

[56] References Cited

U.S. PATENT DOCUMENTS

| | | | |
|---|---|---|---|
| 2,670,946 | 3/1954 | Royster | 432/101 |
| 2,676,095 | 4/1954 | De Vaney et al. | 34/168 |
| 3,371,429 | 3/1958 | Miller et al. . | |

FOREIGN PATENT DOCUMENTS

| | | |
|---|---|---|
| 566331 | 12/1932 | Fed. Rep. of Germany . |
| 934159 | 9/1955 | Fed. Rep. of Germany . |
| 1508507 | 1/1970 | Fed. Rep. of Germany . |
| 2183074 | 12/1973 | France . |
| 2284845 | 6/1978 | France . |
| 587890 | 5/1947 | United Kingdom . |
| 647490 | 12/1950 | United Kingdom . |
| 837175 | 6/1960 | United Kingdom . |
| 1508638 | 4/1978 | United Kingdom . |

*Primary Examiner*—Larry I. Schwartz

*Attorney, Agent, or Firm*—Pennie & Edmonds

[57] ABSTRACT

In apparatus and method for treating granular product within a cylindrical chamber as the product, by the force of gravity, falls through a plurality of regions maintained at varying temperature and pressure. Structure formed by at least a pair of collectors is connected tangentially to a housing surrounding the regions to withdraw gas from and reintroduce gas to the cylindrical chamber. Particularly gas is withdrawn from a lower region, treated by heating and dilution with flue gases prior to reintroduction. Movement of gas is provided by a ventilator which serves to draw fresh air into the cylindrical chamber from the vicinity of the lower region. The flow of gas, the temperature of the gas, and the pressure within the regions result in granular product first moving counter to the flow of gas, then with the flow of gas, and then counter to the flow of gas. The granular product is heated, maintained at a heated temperature, and cooled within these flows.

6 Claims, 6 Drawing Figures

APPARATUS AND METHOD FOR DRYING COMPACT, VITRIFIABLE MIXTURES

TECHNICAL FIELD

The present invention relates to a treatment of granular products, such as conglomerates, and particularly conglomerates made by starting with a vitrifiable compound with a gas for purposes of drying and hardening the product.

BACKGROUND ART

It is known that a powdery mixture may be massed together to form a ball, a small thick, and so forth. Ordinarily, the massing of the mixture which may include various powdery materials contained in a compound is carried out by moisturizing the mixture, with or without a binding material. Often, following this process of massing, the conglomerate or product leaving the compacting mechanism has been found to have weak mechanical characteristics. To avoid the danger that the product may stick to products of like nature, or crumble or break into pieces under strain during subsequent manipulations, generally, the product has been subject to a form of treatment in order to harden them. Treatment follows completion of the massing process. In a great number of cases, treatment is by a simple drying procedure, at ordinary temperatures. Such drying is slow and an amount of stockpiling may result. During such stockpiling, product may deteriorate.

Thus, according to the prior art, product which has been massed together is supported on a conveyor belt and moved through a heating dryer. Unfortunately, however, such apparatus has the disadvantage not only of being cumbersome but they consume a great deal of energy as well.

Accordingly, and for purposes of overcoming the above disadvantages, the present invention provides a compact device in which conglomerates may be dried by being subject to heat with minimum deterioration and under conditions of minimal outlay of energy.

SUMMARY OF THE INVENTION

The present invention is in an apparatus and process for treating granular product. The apparatus includes a housing in the form of a vertically disposed cylindrical column having a chamber and a plurality of regions traversed from top to bottom by the granular product which shall flow down by the force of gravity. A hopper is located at the top of the column thereby to close the top of the upper region for receipt of granular product and a bin is located at the bottom of the column thereby to close the bottom of the lower region for discharge of treated granular product.

The apparatus further includes at least one flow unit having a pair of collectors communicating tangentially with the cylindrical column. One collector serves to extract a gaseous flow from the cylindrical chamber and the other collector serves to reinject a gaseous flow to the cylindrical chamber. The flow unit includes at least a separator, a ventilator and a burner to condition the gaseous flow for reentry.

The apparatus also includes an inlet within the region of the bin for fresh air which enters the cylindrical chamber by action of the ventilator. The granular product to be treated moves in the direction of and opposite to the flow of gas, and through regions at varying temperature and pressure in which the granular product is heated, stabilized in temperature and cooled for purposes of homogeneous hardening. Means are provided for control of level of granular product, temperature and pressure within the regions, and the volume of flow of gas through the regions.

The apparatus of the invention permits a minimization in the consumption of energy. Moreover, for a given working capacity, compactness of apparatus results in low manufacturing and operating costs. This feature constitutes an important advantage over other furnaces, such as the conveyor-belt dryers traditionally used for treating fragile products.

Finally, a great simplification of the feeding and the functioning results from the absence of the sieve for feeding granular product and the manner of circulation of the gases by a ventilator, so that an upper region of the cylindrical column provides a partial vacuum. Further, the apparatus has great stability in the regulation of temperature obtained by diluting the gases from the burners with recycled gases from the cylindrical chamber.

BEST MODE FOR CARRYING OUT THE INVENTION

Figure 1:
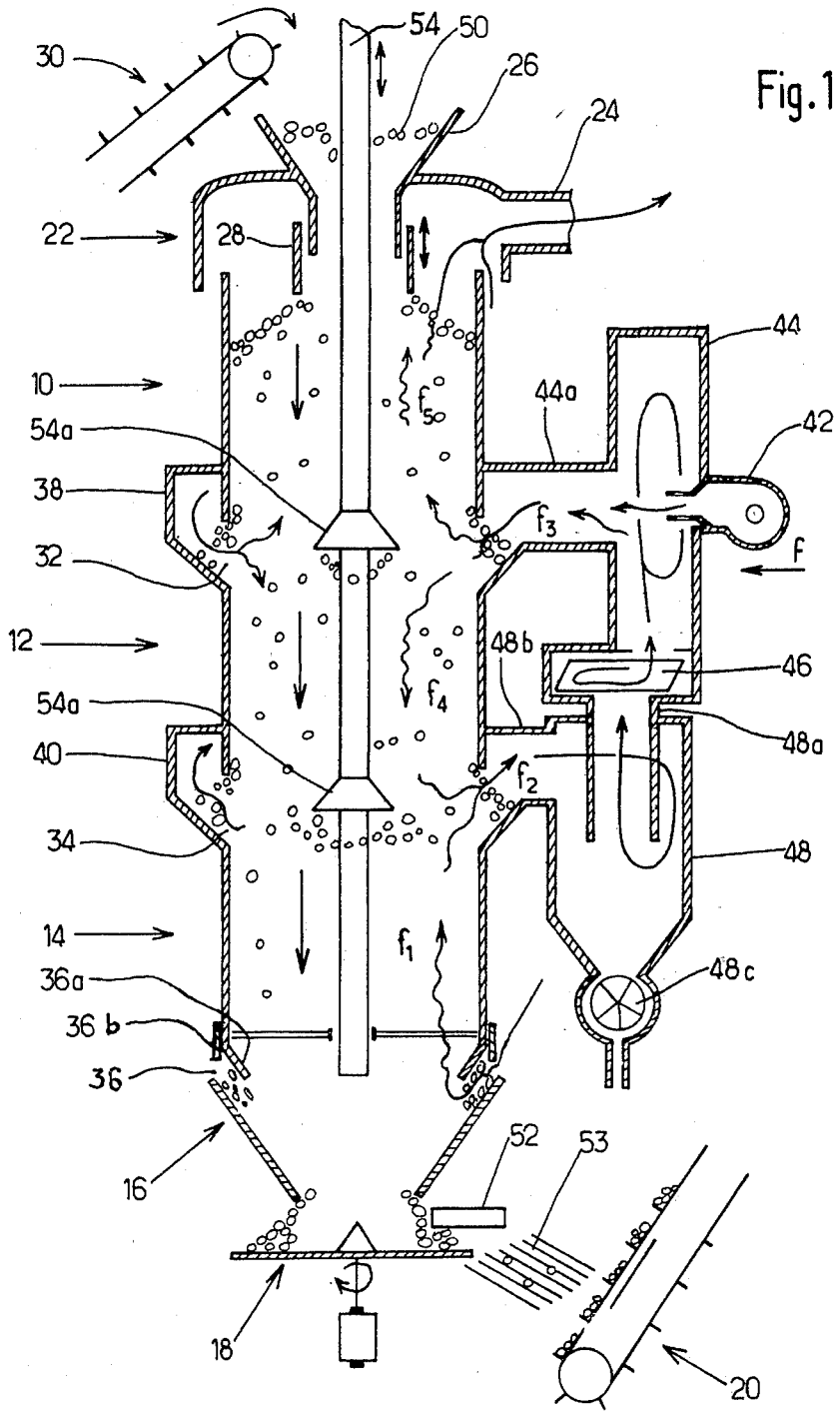
FIG. 1 is an elevational view, partly in cross-section, of the apparatus of the present invention.

The apparatus of the present invention, suitable for thermal treatment of granular product, may be seen to best advantage in FIG. 1. The apparatus is a dryer having a housing in the form of a cylindrical column, vertically oriented, and a chamber having a plurality of regions, from top to bottom. In the form of dryer of FIG. 1, the column includes an upper region 10 adjacent an inlet for granular product, a central region 12 and a lower region 14 immediately above a conical collar forming a bin 16 at an outlet for treated granular product. A distributor is disposed below the outlet. The distributor includes a base plate 18 which feeds treated granular product to an elevator conveyor 20. The base plate is mounted for movement, such as rotation and is driven by a prime mover of any type. The cylindrical chamber needs no sieve or other structure, the height of the column of granular product to be treated being regulated by structure and operation as will be discussed.

A hood 22 is located at the inlet, immediately above the upper region, to substantially close the column. A duct 24 extends from the hood. The duct communicates with an evacuation chimney provided with washing and gas-cleaning devices, and an exhaust fan (not shown), if required. As may be apparent, the fan will create a slight partial vacuum within the proximate vicinity of the duct in the upper region. A hopper 26 is formed in the hood and a skirt 28 surrounds the inlet opening within the region of the hood. The skirt is adjustable vertically to regulate the height of granular product to be treated within the cylindrical column.

A second elevator conveyor 30 communicates the granular product from a compacting press (not shown) to the hopper 26. The conveyor 30 is located so that the granular product to be treated falls in the direction of the arrow into the hopper.

Structure is located both in and about the periphery of the column providing a flow of fluid into or out of the column. Generally, the structure includes a plurality of inlets 32, 34 and 36 which are located at a separation of the several regions, one from another, and the lower region from bin 16. The inlets 32 and 34 communicate, respectively, with collectors 38 and 40, each of which leads into a spiral duct disposed partially about the column and tangentially intersecting the wall of the column in a trapezoidal section. The lower wall of the section is connected with the cylindrical wall of the column within the vicinity of the next lower region. The lower wall is inclined to the horizontal at an angle of about 45° to 60°.

The inlet 36 extends around the column between the lower region 14 and bin 16. The inlet is along a wall 36*a* in the form of a truncated cone residing substantially parallel to the wall of bin 16. An element 36*b* formed by a cylindrical collar is received about the column. The element is movable vertically relative to the inlet opening to regulate a flow of air represented by the arrow f1 in FIG. 1, entering into the column. The air entering the inlet 36 is ambient air.

The structure of inlets 32 and 34 providing for flow of fluid into and out of the column may be seen, perhaps to best advantage, in FIGS. 2–5. The structure includes three inlet conduits 44*a* which communicate with collector 38 and three outlet conduits 48*b* which communicate with collector 40. The inlet conduits and the outlet conduits are located at equidistant spacing about the cylindrical conduit and communicate the flow of fluid both out of and into the cylindrical chamber along substantially a tangential path.

The structure providing for flow of fluid also includes an inlet casing 44, a ventilator 46 in the form of a fan and a separator 48 for each of the several inlet and outlet conduits. Each inlet casing and separator are arranged in a vertical column to provide a flow of fluid, to be described, from the separator into the ventilator located above the separator and then into the inlet casing. A system of outlet pipes 48*a* communicate each separator and ventilator. The outlet pipes provide a housing for the fan of ventilator 46 which rotates about an axis coaxial with the outlet pipe.

A burner 42 (see FIG. 1) is disposed in each inlet casing 44 and generally along its axis. The burner is fed by a flow of fluid possibly from both an independent source and the ventilator 46. The flow of fluid from the ventilator, prior to re-entry into the cylindrical column at collector 38 is both heated and diluted.

A sieve 48*c* located below separator 48 functions to draw off fine particulate collected in the separator.

As may be apparent, the inlets, such as inlet 36 for admitting fresh air, will permit a flow adequate to carry out the process and the ventilator 46 should have a capacity to provide the desired flow into and through the cylindrical chamber. Additionally, the burner 42 should be capable of maintenance of a thermal level within the cylindrical chamber.

In operation, granular product, illustrated as individual compacted elements 50, from the compacting press, is raised to the height of hopper 26 and allowed to fall from the ribs of the conveyor 30 to enter into the column. The granular product, then, by the force of gravity, descends along the length of the column through the several regions to the discharge bin 16. The granular product enters the cylindrical chamber at about ambient temperature.

Ventilator 46 creates a partial vacuum within the column for purposes of drawing fresh air primarily through inlet 36, and, secondarily, through the lower or discharge opening of bin 16. The air follows a path through the lower region of the column toward collector 40 (arrow f1). The air, then, enters the collector (arrow f2) in flow into the inlet casing to mix with flue gas from burners 42. Finally, the mixture of air from the lower region and flue gas is reintroduced into the column through collector 38 (arrow f3). The mixture of gases is reintroduced into the column under pressure. Therefore, because of a partial vacuum prevailing in the column at the level of the collector 40, a major portion of the mixture of gases is drawn downward into the middle region of the column (arrow f4). This portion of the mixture of gases enters collector 40 (arrow f2); the minor portion of the mixture of gases is forced upward into the upper region of the column (arrow f5) toward duct 24 and evacuation chimney. The slight partial vacuum in the evacuation chimney, heretofore discussed, serves in movement of gases upward and will prevent the gases in circulation from being forced back into the atmosphere of the shop.

The tangential extraction from and reinjection of gases into the column result in a regular distribution of the gaseous currents throughout the respective regions, while the presence of granular product prevents the formation of disturbing swirling movements. Thus, in the course of progress along the column, the granular product, initially at ambient temperature, encounters as ascending current of gas (f5), under pressure, in the upper region of the column. This gas is made up of diluted flue gas from burners 42. Thus, the temperature of granular product, at least for the superficial portion, is quickly but evenly elevated to the maximum level desired to dry. Heating such of the elements of granular product strengthens them without shattering, and they lose a substantial amount of their humidity or percentage by weight of water while subject to the ascending current.

Granular product, then, descends into and through the middle region 12, moving with the recycled major portion of gas (f4). The granular product, in this way, is thoroughly heated and dried. Finally, the granular product descends into the lower region entering the ascending current of fresh air (f1). The granular product gives up the major part of its temperature in heat exchange with the fresh air within the lower region. Additional heat is lost within the bin 16 so that the granular product withdrawn from the column is at a temperature substantially equal to that upon entry into the column. The fresh air following contact with granular product mixes with the current of recycled smoke in each of the collectors. In this manner, the temperature of gas is elevated to the desired temperature for heating the granular product.

Separators 48 ensure the elimination of the fine particulate, which may be returned to the compacting press. This operation protects the ventilators 46.

From the above, it may be seen that granular product first is brought to its drying temperature through loss of a large part of its humidity through methodical exchange of heat with the hot gases rising toward the upper region of the cylindrical column; then the granular product is stabilized in regard to temperature and heated thoroughly by an antimethodical exchange with the gases circulating in the middle region at a relatively moderate temperature, from which the granular product attains homogeneous hardening characteristics; and finally, the granular product is reduced in temperature by a methodical exchange with the fresh air introduced at the lower region of the cylindrical column.

The great efficiency of heating of granular product obtained in the upper region, because of methodical exchange of heat therein, makes it possible to provide for a middle region of a height which is large by comparison with the total height of the cylindrical column, while ensuring homogeneity of treatment. Furthermore, the dilution of the extremely hot gases from the burners 42 by the gaseous flow (f2) from collectors 40, even though at a temperature still relatively high makes it possible to obtain a good stability of temperature without a need to resort to employment of a very fine adjustment of the functioning of the burners.

The treated granular product is discharged by the distributor from the bin 16. These balls are strengthened and at about ambient temperature. A scraper 52 located above the base plate may be used for this purpose, if necessary. The granular product is discharged to a grate 53 which may be inclined toward the conveyor 20 and downstream storage, for example. The granular product may roll along the grate and separate from the fine particles or other debris which has formed thereon.

The truncated-cone shape of the walls of the lower part of the inlets 32, 34 and 36 facilitates the restoration of the slope of the granular product, commonly referred to as "angle of repose", naturally formed when the material is deposited in a heap without compression and, thus, prevents clogging and facilitates the regular passage of gases.

A tube 54 is disposed within the column, preferably to extend along its axis. The tube is of a length to extend from a location above the hood 22 to a location substantially within the confines of bin 16. The tube is adapted to be adjusted in height by means of sliding elements (not shown) and, as may be necessary, supports one or more deflectors 54*a*. The tube serves in preventing the formation of a dead area within and along the central part of the column. Additionally, friction between granular product and the wall of the tube of the granular product which progresses more uniformly through the column. Distributor 18, also, acts in the control of descent of the granular product through the column. Control of descent of granular product will results from control of the speed of rotation of the base plate and/or the position of scraper 52.

As illustrated in FIG. 1, deflectors 54*a* may be conical in shape and located between the upper and middle regions, as well as between the middle and lower regions of the column. The deflectors make it possible to maintain a charge of granular product at substantially a constant value in flow, and as may be apparent, the height of the deflectors follows the vertical sliding adjustment of the tube.

Preferably, a detector will be located in hopper 26. Such a detector will provide a safety function thereby discontinuing operation of the column when the level of granular product, because of a failure in the feeding of granular product, for example, falls below a minimum level. Other controls may be resorted to for various reasons. Thus, it is contemplated that one may adjust the drying temperature and its effectiveness on the granular product by controlling the yield of the burners and modifying the output of the fans 46. Controls of this type are conventional. Also, the skirt 28 may be displaced vertically to control the height of the granular product in the upper region 10 of the column, as well as to adjust the rate at which the hot gaseous flow is recycled. By adjusting the distribution of the hot gaseous flow within the upper region of the column, one may adjust the drop in pressure within the upper region.

Figure 6:
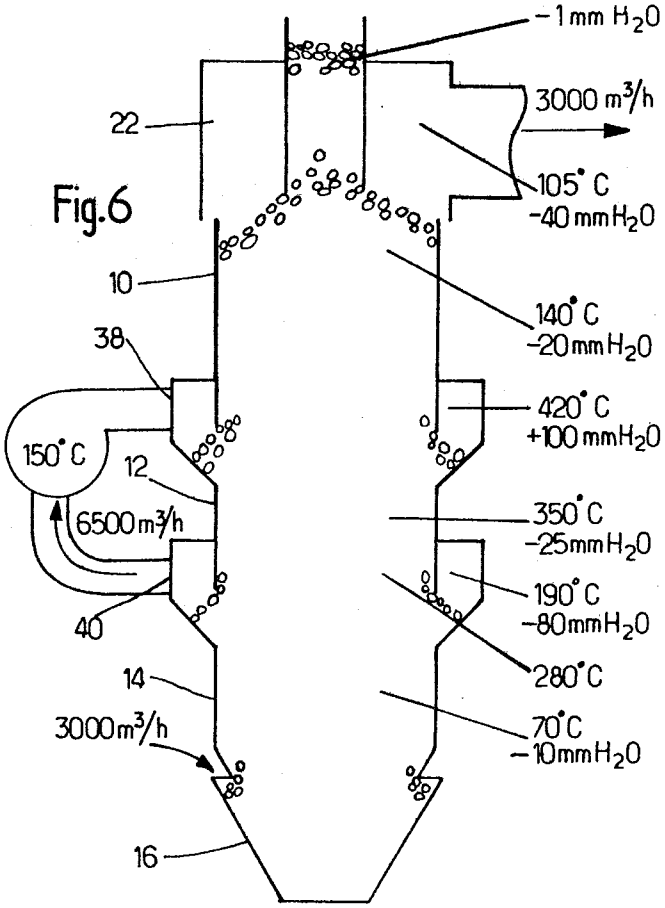
FIG. 6 is a schematic view illustrating those pressures and temperatures as may be found within the chamber of the apparatus.
Figure 2:
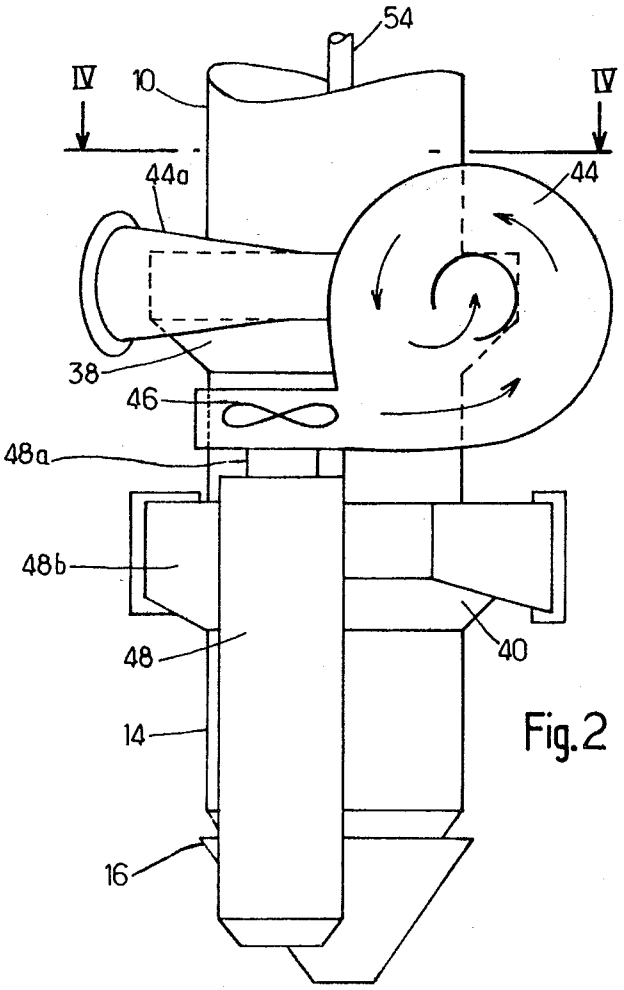
FIG. 2 is a partial elevational view of the apparatus of FIG. 1 looking in the direction of the arrow "F" (FIG. 1)
Figures 3, 4, 5:
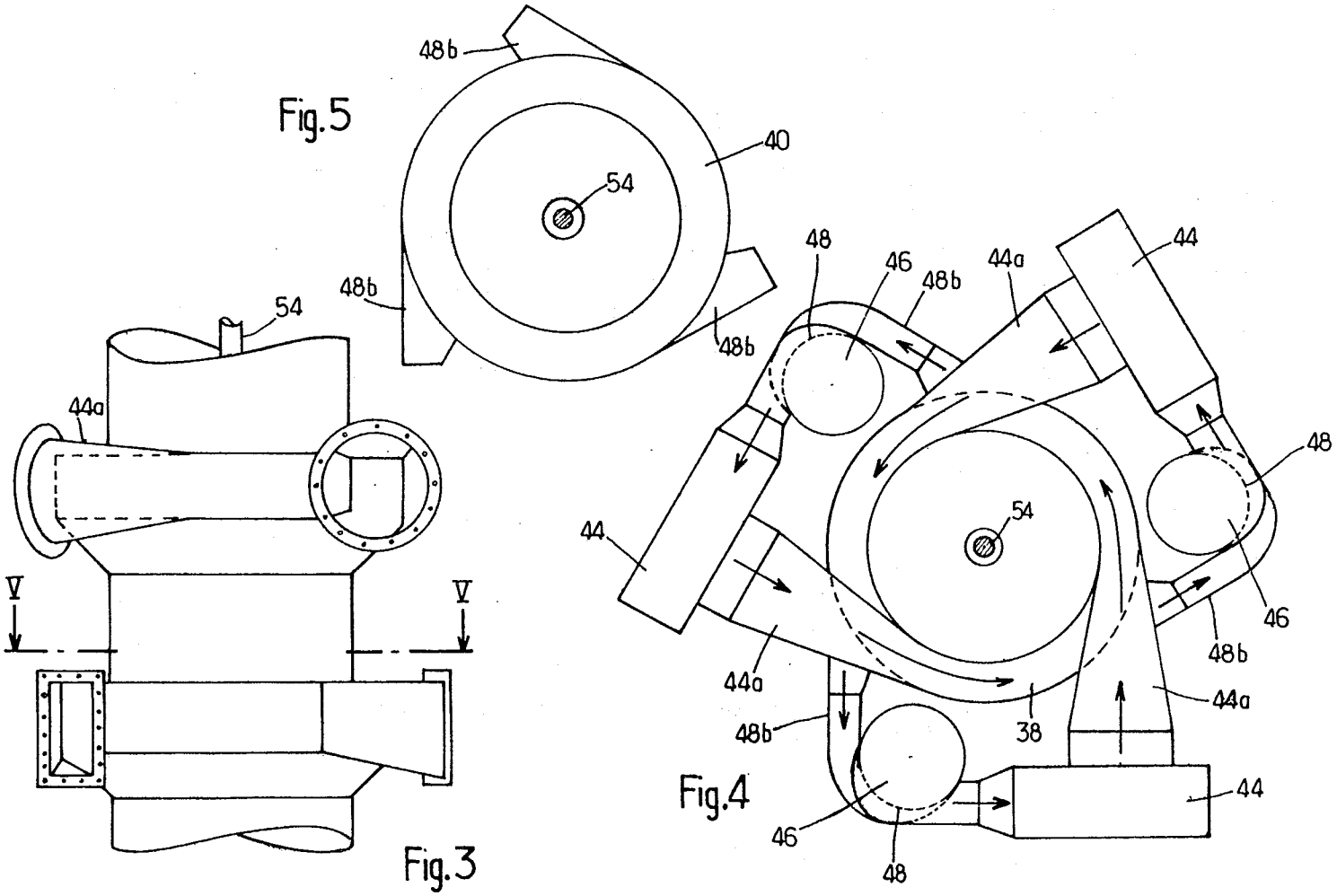
FIG. 3 is a view similar to that of FIG. 2 with a portion of structure removed.
FIG. 4 is a view in section as seen along the line IV—IV in FIG. 2.
FIG. 5 is a view in section as seen along the line V—V in FIG. 3.

With reference to FIG. 6, one may see comparative figures derived through operation of the dryer of the present invention. Without intent to limit the invention but rather to introduce a greater measure of significance to the comparative figures, the dryer has an inner diameter of 1.2 meters and a total height of 4 meters. The granular product for treatment was in the form of balls, made from a silica-soda-lime glass batch, containing about 6% by weight water. The balls entered the hopper at a flow of 6 tons per hour and an average residence of from 30 to 40 minutes within the column.

Natural gas was consumed by the dryer at a rate of consumption of from 25 to 30 cubic meters per hour. A recirculation output of 8,500 cubic meters per hour was provided by the fans, and the total consumption of power was in the range of from 40 to 50 kilowatts. According to this criteria, the following performances were obtained:

Maximum temperatures attained by the central region of the column: 200° to 250° C.

Outlet temperature of the gases: 80° to 120° C.

Outlet temperature of granular product: 30° to 60° C.

Water (percent by weight) at the outlet: 0.5 to 1.

It is interesting, once again, to note that the dryer makes it possible to treat granular product in the form of balls or other conglomerates in a uniform, continuous and rapid manner, without that granular product undergoing thermal shock which would be very unfavorable to its mechanical behavior, and in spite of the absence of any complicated process of regulating the burners. This result is achieved through utilization of a large volume of gas at relatively low temperature, circulating within the column.

I claim:

1. A process of drying granular product including introducing product into a dryer at one end and moving said product toward the other end in an approximately vertical direction by the force of gravity through a plurality of regions, introducing a fluid for treating said product into said dryer at the other end, and subjecting said product successively, during movement, to a counter-current flow in an upper region, a co-current flow in an central region, and a counter-current flow in a lower region, respectively, wherein said flows in said upper and central regions are at temperatures higher than the temperature of said product and said flow in said lower region is at a temperature lower than the temperature of said product, said flow of fluid for treating said product in said central region comprising a recycled portion of said flow which shall have first moved through said lower region, characterized in that said flow in said lower region when contacting said granular product is at a pressure which is equal to or slightly less than the atmospheric pressure.

2. The process as claimed in claim 1, characterized in that said flow in said upper region is at a pressure which is equal to or preferably slightly less than atmospheric pressure when leaving the granular product.

3. The process as claimed in claim 1 or claim 2, characterized in that the said flow in said upper region is created by a difference in pressure between a pressure greater than the atmospheric pressure and a pressure lower than the atmospheric pressure.

4. The process as claimed in claim 1 or 2, characterized in that the temperature of said flow in said upper region after flowing through said granular product is greater at the dew point.

5. The process as claimed in claim 1 or 2, characterized in that the flow volume in said central region is at least equal to that of the flow volume in said lower region and greater than that of the flow volume in said upper region.

6. Apparatus for the treatment of granular product in the form of individual conglomerates of vitrifiable material comprising a housing having an internal chamber, means for introducing said product to said chamber at one end of said housing whereby said product moves through a plurality of regions including an upper, central and lower region under gravitational forces toward the other end of said housing, means adjacent said other end of said housing providing an opening into said chamber for fluid for treating said product, said fluid adapted to follow a path of movement from said opening upwardly into said chamber, means including three flow connections each communicating an inlet and an outlet arranged at 120° spacing around the housing for flowing a substantial volume of said treating fluid from said chamber during movement and returning said treating fluid to said chamber, a centrifugal ventilator disposed in each flow connection downstream of a cyclone, a burner likewise disposed in each flow connection downstream of said centrifugal ventilator and along the axis of said inlet for dilution of treating fluid which shall follow a path through the respective flow connections, the system of inlets and outlets for dilution being connected tangentially to said housing and including ducts connected to said flow connection extending at least partially about said housing, each said inlet formed in a wall of said housing substantially between said central and lower regions and each said outlet likewise formed in said wall between said central and upper regions, and wherein said centrifugal ventilator within each flow connection provides a negative pressure at each said inlet whereby said treating fluid is drawn continuously into said chamber and whereby a major portion of the volume of treating fluid circulating through each said flow connection from said inlet to said outlet returns to an inlet following a path of movement with said product.

* * * * *

UNITED STATES PATENT AND TRADEMARK OFFICE

CERTIFICATE OF CORRECTION

PATENT NO. : 4,351,119

DATED : September 28, 1982

INVENTOR(S) : Georges Meunier

It is certified that error appears in the above-identified patent and that said Letters Patent are hereby corrected as shown below:

Column 1, line 6, "a" should be --the--.

Column 1, line 14, "thick" should be --stick--.

Column 4, line 45, "such" should be --each--.

Column 6, line 58, "an" should be --a--.

Column 7, line 6, "upper" should be --central--.

Signed and Sealed this

*Twenty-first* Day of *December 1982*

[SEAL]

*Attest:*

GERALD J. MOSSINGHOFF

*Attesting Officer*

*Commissioner of Patents and Trademarks*